US006038529A

United States Patent [19]

Harada

[11] Patent Number: 6,038,529

[45] Date of Patent: Mar. 14, 2000

[54] TRANSMITTING AND RECEIVING SYSTEM COMPATIBLE WITH DATA OF BOTH THE SILENCE COMPRESSION AND NON-SILENCE COMPRESSION TYPE

[75] Inventor: Ryoichi Harada, Tokyo, Japan

[73] Assignee: NEC Corporation, Tokyo, Japan

[21] Appl. No.: 08/902,264

[22] Filed: Jul. 29, 1997

[30] Foreign Application Priority Data

Aug. 2, 1996 [JP] Japan ..... 8-205123

[51] Int. Cl.[7] ..... G10L 9/00

[52] U.S. Cl. ..... 704/215; 704/210

[58] Field of Search ..... 704/210, 215

[56] References Cited

U.S. PATENT DOCUMENTS

| | | | |
|---|---|---|---|
| 5,414,796 | 5/1995 | Jacobs et al. | 704/221 |
| 5,452,289 | 9/1995 | Sharma et al. | 370/271 |
| 5,475,712 | 12/1995 | Sasaki | 275/241 |
| 5,509,102 | 4/1996 | Sasaki | 704/219 |
| 5,539,858 | 7/1996 | Sasaki | 704/212 |
| 5,553,190 | 9/1996 | Ohya et al. | 704/201 |
| 5,553,192 | 9/1996 | Hayata | 704/228 |
| 5,654,964 | 8/1997 | Wake | 370/395 |
| 5,657,421 | 8/1997 | Lorenz et al. | 704/223 |
| 5,687,283 | 11/1997 | Wake | 704/215 |
| 5,974,374 | 10/1999 | Wake | 704/215 |

FOREIGN PATENT DOCUMENTS

| | | | |
|---|---|---|---|
| 1-173100 | 7/1989 | Japan | G10L 5/00 |
| 2-42500 | 2/1990 | Japan | G10L 9/18 |
| 3109840 | 5/1991 | Japan | H04L 12/56 |
| 4-315329 | 11/1992 | Japan | G10L 3/00 |
| 4357735 | 12/1992 | Japan | H04L 12/56 |
| 5-22153 | 1/1993 | Japan | G10L 9/14 |
| 5-136746 | 6/1993 | Japan | G10L 7/02 |
| 683399 | 3/1994 | Japan | G01L 9/18 |
| 6314098 | 11/1994 | Japan | G10L 3/00 |
| 7-36497 | 2/1995 | Japan | G10L 9/18 |
| 7-177105 | 7/1995 | Japan | G10L 3/00 |
| 7254878 | 10/1995 | Japan | G10L 3/00 |
| 7334197 | 12/1995 | Japan | G10L 9/14 |

*Primary Examiner*—David R. Hudspeth
*Assistant Examiner*—Tālivaldis Ivars Šmits
*Attorney, Agent, or Firm*—Sughrue, Mion, Zinn Macpeak & Seas, PLLC

[57] ABSTRACT

A signal communication apparatus and method enables direct communication between communication systems of the silence compression and the non-silence compression type. The transmission and reception can each discriminate whether an audio signal is in a sound-present period or in a sound-absent period and this discrimination is output as period identification data. The audio signal is encoded, and the encoded data is selected and transmitted when the period identification data represents a sound-present period. Blank data prepared in advance are selected when the period identification data represents a sound-absent period. Encoded audio signal data of a variable bit rate are received, and the encoded data is selected, decoded, and output at a fixed bit rate when the period identification data represents a sound-present period. Data prepared in advance are outputted when the period identification data represents a sound-absent period. Multiplexing of period identification data can be used in a transmitter or receiver.

32 Claims, 4 Drawing Sheets

TRANSMITTING AND RECEIVING SYSTEM COMPATIBLE WITH DATA OF BOTH THE SILENCE COMPRESSION AND NON-SILENCE COMPRESSION TYPE

BACKGROUND OF THE INVENTION

1. Field of the Invention

This invention relates to a method and an apparatus for encoding and communicating an audio signal in a digital mobile telephone system or a like system.

2. Description of the Related Art

Conventionally, in a signal communication system such as a digital mobile telephone system, in order to reduce the amount of data of an audio signal to be transmitted, an encoding transmission apparatus compresses the audio signal by encoding and transmits the encoded audio signal, and a reception decoding apparatus decompresses the received audio signal by decoding.

Normally, in conversation of human beings, a sound-present period is not continuous, but a sound-present period and a sound-absent period appear alternately. However, in a signal communication system of the type called non-silence compression type, the encoding transmission apparatus successively encodes and transmits an audio signal without making a distinction between a sound-present period and a sound-absent period, and the reception decoding apparatus successively receives and decodes the encoded data.

However, since it is wasteful to communicate also in a sound-absent period in this manner, in a signal communication system of the type called silence compression type, encoded data only in a sound-present period are transmitted, whereas encoded data in a sound-absent period are not transmitted, thereby further reducing the amount of data to be transmitted.

In such a signal communication system of the silence compression type as described above, since the encoding transmission apparatus intermittently transmits only encoded data in sound-present periods, a processing operation in a sound-absent period and a background noise inserting operation of the reception decoding apparatus must be matched with a processing operation of the encoding transmission apparatus. Therefore, in order to prevent deterioration in quality of an audio signal, various processes are executed.

Various conventional examples which relate to such a signal communication system as described above are disclosed in Japanese Patent Laid-Open Application No. 334197/95, Japanese Patent Laid-Open Application No. 314098/94, Japanese Patent Laid-Open Application No. 357735/92, Japanese Patent Laid-Open Application No. 109840/91, Japanese Patent Laid-Open Application No. 83399/94, and so forth.

The encoding transmission apparatus disclosed in Japanese Patent Laid-Open Application No. 334197/95 as a conventional example is described below with reference to FIG. 1. FIG. 1 is a block diagram showing a signal encoding unit of the encoding transmission apparatus.

The signal encoding unit 101 includes an input wiring 102, to which an audio signal is inputted. A sound-presence/absence discrimination unit 103 and an encoding processing unit 104 are connected in parallel to each other to the input wiring 102, and the output of the sound-presence/absence discrimination unit 103 is connected also to the encoding processing unit 104.

A parameter working unit 105 is connected to the encoding processing unit 104, and the sound-presence/absence discrimination unit 103 is connected also to the parameter working unit 105. An error correction unit 106 is connected to the parameter working unit 105, and the error correction unit 106 is connected to an output wiring 107.

The sound-presence/absence discrimination unit 103 mentioned above discriminates an audio signal between a sound-present period and a sound-absent period, and the encoding processing unit 104 encodes the audio signal in a sound-present period in accordance with the CELP system and outputs a speech parameter. However, in a sound-absent period, the encoding processing unit 104 encodes the audio signal at a first initial interral and after each subsequent fixed interral of the sound-absent period in a similar manner as in a sound-present period and outputs a speech parameter similarly as in a sound-present period.

The parameter working unit 105 mentioned above processes a speech parameter encoded by the encoding processing unit 104 based on the result of discrimination of the sound-presence/absence discrimination unit 103 mentioned above. More particularly, the parameter working unit 105 invalidates a long term predicted delay (LAG) which relies on a previous state of the audio parameter, processes a long term predicted gain into a minimum quantized value and outputs the quantized value.

The error correction unit 106 for correcting an error of encoded data is connected to the parameter working unit 105. The error correction unit 106 is connected to the output wiring 107 for outputting encoded data. Since the error correction unit 106 encodes an audio parameter, the encoded data is outputted as a compressed audio signal from the output wiring 107.

Since the audio signal encoded and compressed by the signal encoding unit 101 as described above is transmitted from the encoding transmission apparatus to the reception decoding apparatus, the reception decoding apparatus decodes and decompresses the received audio signal.

When the encoded data in a sound-absent period are to be decoded, a long term predicted signal which makes use of a correlation with a previous signal is invalidated, and encoded data sent thereto at fixed intervals are successively interpolated during a time within which no encoded data are sent thereto so that the interpolated encoded data are decoded to obtain sound that is not incongruous.

Meanwhile, the reception decoding apparatus disclosed in Japanese Patent Laid-Open Application No. 314098/94 discriminates, after it receives and decodes an audio signal, a sound-absent period from a succession of minimum values in quantized values of the power (sound volume) of the audio signal, and suppresses, in a sound-absent period, the power of the reproduced sound to reduce noise.

In the signal communication system disclosed in Japanese Patent Laid-Open Application No. 357735192, in order to cope with a level (sound volume) variation of background noise during a sound-absent period, an encoding transmission apparatus transmits a noise level at fixed intervals within the sound-absent period. A reception decoding apparatus inserts background noise into the sound-absent period based on the received noise level so that natural sound may be reproduced.

In the signal communication system disclosed in Japanese Patent Laid-Open Application No. 109840/91, an encoding transmission apparatus transmits, when a level variation of background noise is detected in a sound-absent period, noise level data and an identifier that represents whether that encoded data are abandoned. A reception decoding apparatus distinguishes abandonment of encoded data and a sound-absent period from each other based on the identifier.

By this construction, the encoding transmission apparatus and the reception decoding apparatus can operate equivalently in a sound-present period and a sound-absent period. Consequently, background noise in a sound-absent period can be regenerated with a high fidelity, and also missing of encoded data in a sound-present period can be prevented.

In the reception decoding apparatus disclosed in Japanese Patent Laid-Open Application No. 83399/94, in a sound-absent period, a code vector of zero or of a small magnitude is inputted to a synthesizer filter which synthesizes speech with the code vector. The level of the decoded sound is reduced smoothly to prevent production of click noise or like noise at an instant of changing over from a sound-present period to a sound-absent period.

Either such a signal communication system of the silence compression type in which no communication is performed in a sound-absent period or another signal communication system of the non-silence compression type wherein communication is performed also in a sound-absent period as described above, can be applied to a signal communication system of an ATM (Asynchronous Transfer Mode) system or an SDH (Synchronous Digital Hierarchy) system.

However, it is not easy to connect a signal communication system of the silence compression type having a variable bit rate and another signal communication system of the non-silence compression type having a fixed bit rate to each other.

In short, in a signal communication system of the silence compression type, in a non-transmission period of encoded data in a sound-absent period, decoding processing for encoded data is not performed but interpolation processing of background noise is performed as in the conventional example disclosed in Japanese Patent Laid-Open Application No. 334197/95. In the meantime, in another signal communication system of the non-silence compression type, encoding and decoding of an audio signal are performed in all periods irrespective of whether sound is present or absent.

If encoded data are directly transmitted from an encoding transmission apparatus of the silence compression type to a reception decoding apparatus of the non-silence compression type, then since the encoding transmission apparatus of the silence compression type does not transmit encoded data in a sound-absent period, the signal processing apparatus of the non-silence compression type cannot perform decoding processing in a sound-absent period.

In order to prevent this, when encoded data are to be transmitted from the encoding transmission apparatus of the silence compression type to the reception decoding apparatus of the non-silence compression type, at a connection location between the signal communication systems of the silence compression type and the non-silence compression type, it is necessary to decode the encoded data of the silence compression type into an audio signal and then encode the audio signal into data of the non-silence compression type.

In other words, encoding and decoding are performed once for each of the silence compression type and the non-silence compression type, and consequently, data are deteriorated significantly by the repetition of processing. Further, since an encoding transmission apparatus and a reception decoding apparatus of different ones of the silence compression type and the non-silence compression type cannot be connected directly to each other, the entire system is complicated in structure.

The signal communication systems of the documents mentioned above are all directed to improvement in sound quality in a sound-absent period and cannot allow mutual connection between a signal communication system of the silence compression type of a variable bit rate based on compression of silence and another signal communication system of the non-silence compression type that processes encoded data of a fixed bit rate.

SUMMARY OF THE INVENTION

It is an object of the present invention to provide an encoding transmission method and apparatus of the silence compression type which can communicate a signal directly to a reception decoding apparatus of the non-silence compression type.

According to an aspect of the present invention, there is provided an encoding transmission apparatus of the silence compression type, wherein an audio signal is encoded and is transmitted in a sound-present period and is not transmitted in a sound-absent period, comprising:

identification output means for discriminating whether the audio signal is in a sound-present period or a sound-absent period and outputting period identification data;

encoding means for encoding the audio signal and outputting the encoded data at a fixed bit rate; and transmission discrimination means for withholding transmission of the encoded data outputted from said encoding means when the period identification data outputted from said identification output means represents a sound-absent period, and transmitting the encoded data when the period identification data represents a sound-present period.

According to an aspect of the present invention, there is provided a reception decoding apparatus of the silence compression type for receiving and decoding encoded data of a variable bit rate which are transmitted in a sound-present period of an audio signal and are not transmitted in a sound-absent period of the audio signal, comprising:

data reception means for receiving the encoded data of a variable bit rate;

rate conversion means for selecting, when said data reception means periodically receives the encoded data, the encoded data received by said data reception means, and selecting, when said data reception means does not receive the encoded data after each fixed period, encoded data of a sound-absent state prepared in advance, and outputting the selected encoded data at a fixed bit rate; and decoding means for decoding and outputting the encoded data outputted at the fixed bit rate by said rate conversion means.

In the encoding transmission method and apparatus of the present invention, since a sound-present period and a sound-absent period of an audio signal are discriminated and encoded data of the audio signal are transmitted only for the sound-present period, the capacity of transmission data required for the encoding transmission apparatus of the silence compression type is reduced, and it is possible to multiplex some other transmission data with the audio signal in the sound-absent period.

However, since blank data are transmitted in the sound-absent period, the encoding transmission apparatus of the present invention transmits both the encoded data in the sound-present period and the blank data in the sound-absent period at a fixed bit rate. Accordingly, even if the transmission data are received directly by a reception decoding apparatus of the non-silence compression type, the reception decoding apparatus can perform decoding of the transmission data in a manner similar to the decoding of; transmission data of the non-silence compression type.

For example, if the encoding transmission apparatus encodes the audio signal in accordance with the ITU-T Recommendations G.728 system and transmits, as the blank data, a pattern wherein one of two binary values appears successively, then the blank data are decoded into a sound-absent state by a reception decoding apparatus of the non-silence compression type of the ITU-T Recommendations G.728 system.

It is to be noted that, even if the blank data are transmitted in the sound-absent period, it is possible to multiplex some other transmission data with the blank data, and if the transmission data multiplexed in this manner are demultiplexed and replaced with the blank data before they are received by a reception decoding apparatus of the non-silence compression type, then decoding of the transmission data is performed without any trouble.

In the reception decoding method and apparatus of the present invention, as described above, a sound-present period and a sound-absent period of an audio signal are discriminated whether or not encoded data are received after each fixed period, and the encoded data only in the sound-present period are decoded and outputted whereas, in the sound-absent period, a sound-absent state prepared in advance is regenerated. Consequently, an audio signal which is not unnatural can be regenerated from the encoded data of the silence compression type.

However, since the encoded data or artificial noise for regeneration of a sound-absent state is prepared in advance and because the sound-present period and the sound-absent period are discriminated from a reception state of the encoded data, an encoding transmission apparatus need not perform peculiar data processing in order to cause the reception decoding apparatus to discriminate a sound-absent period and regenerate a sound-absent state.

Consequently, even if transmission data of an encoding transmission apparatus of the non-silence compression type are received directly by the reception decoding apparatus of the present invention, the reception decoding apparatus can decode both the transmission data of the non-silence compression type and transmission data of the silence compression type.

For example, when the encoding transmission apparatus decodes the audio signal in accordance with the ITU-T Recommendations G.728 system, ,to since an encoding transmission apparatus of the non-silence compression type of the ITU-T Recommendations G.728 system transmits, in a sound-absent state, a pattern wherein "0" appears successively, the pattern is discriminated as a sound-absent state and a sound-absent state is regenerated by the reception decoding apparatus of the present invention.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS

Figure 1:
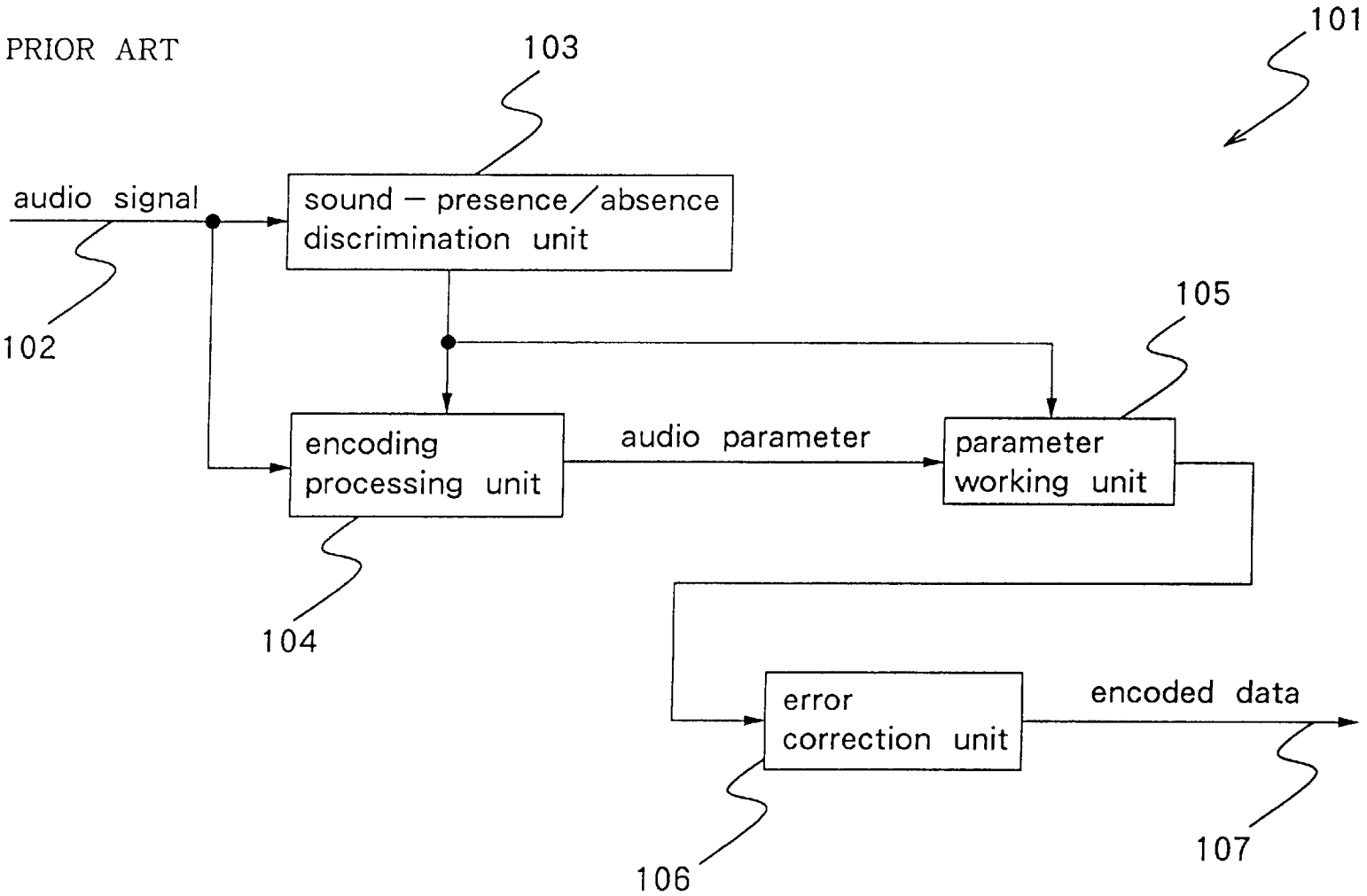
Fig. 1 PRIOR ART
FIG. 1 is a view showing a construction of a conventional example.
Figure 2:
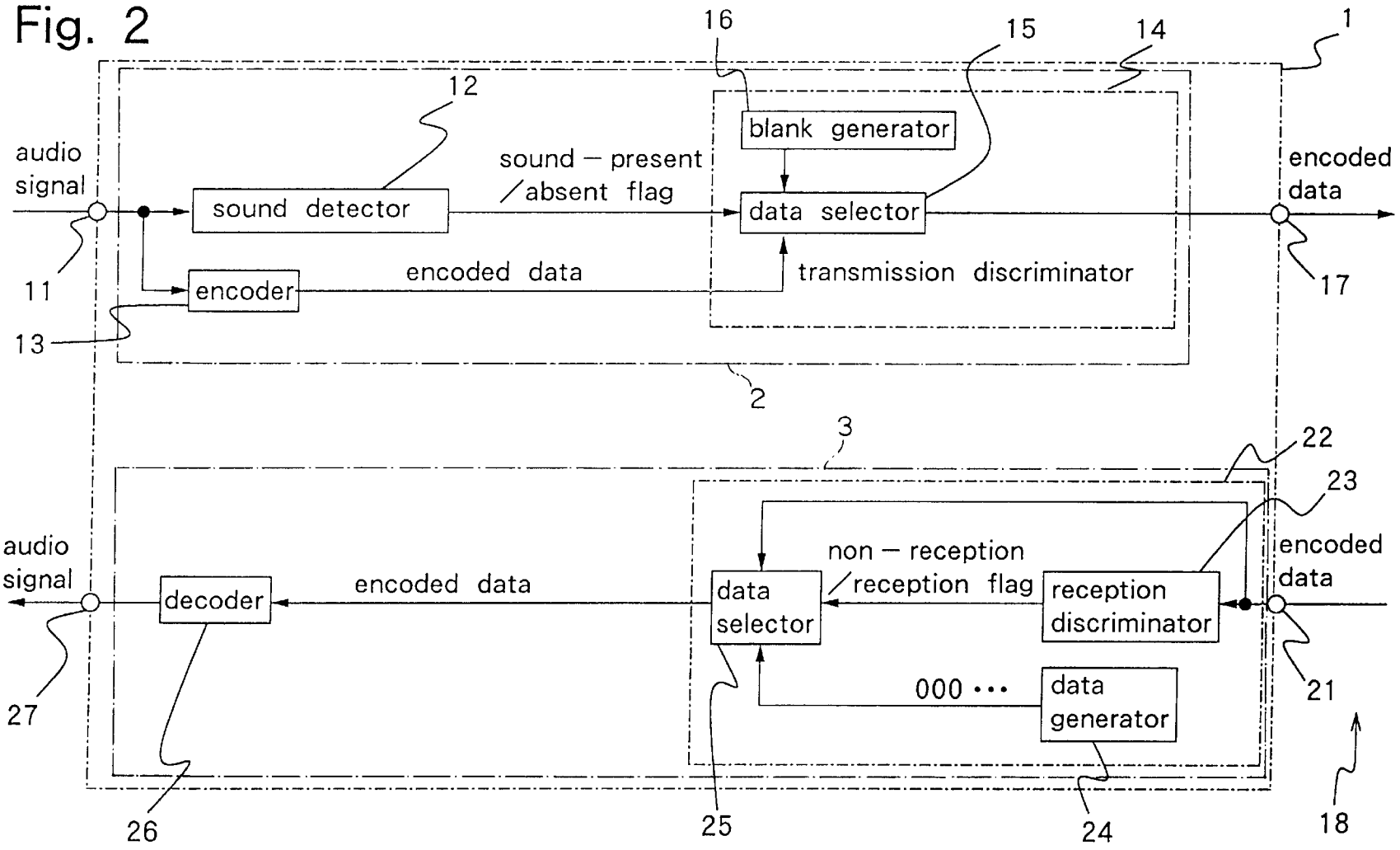
FIG. 2 is a view showing a construction of a first embodiment of a signal communication apparatus of the present invention.

A first embodiment of the present invention is described below with reference to the drawings.

The signal communication apparatus 1 of the present embodiment includes a signal transmission unit 2 which corresponds to an encoding transmission apparatus, and a signal reception unit 3 which corresponds to a reception decoding apparatus.

The signal transmission unit 2 includes an audio inputting element 11 to which a digital audio signal is externally inputted. A sound detector 12 serving as identification output means and an encoder 13 serving as encoding means are connected in parallel to each other to the audio inputting element 11.

The sound detector 12 discriminates whether or not an audio signal is in a sound-present period or a sound-absent period, and selectively outputs a sound-present flag or a sound-absent flag as binary period identification data corresponding to a result of the discrimination. The encoder 13 encodes an audio signal in accordance with the ITU-T Recommendations G.728 system irrespective of whether sound is present or absent, and outputs the encoded data at a fixed bit rate.

It is to be noted that the sound detector 12 and/or the encoder 13 described above are realized with an existing technique such as, for example, a microcomputer in which a suitable program is installed or hardware formed from suitable wired logic.

The sound detector 12 and the encoder 13 are connected to a transmission discriminator 14 serving as transmission discrimination means. The transmission discriminator 14 includes a signal selector 15 serving as signal selection means and a blank generator 16 serving as blank generation means.

The blank generator 16 and the encoder 13 are connected to a pair of input terminals of the signal selector 15, and the sound detector 12 is connected to a control terminal of the signal selector 15.

The blank generator 16 is formed, for example, from a memory such as a RAM or from a constant voltage source such as a grounding terminal and generates a pattern wherein "0" appears successively as a string of blank data that correspond to encoded data of a sound-absent state according to the ITU-T Recommendations G.728 system.

The signal selector 15 selects encoded data outputted from the encoder 13 or blank data generated by the blank generator 16 in response to a sound-present flag or a sound-absent flag outputted from the sound detector 12.

In short, encoded data outputted from the encoder 13 are outputted at a variable bit rate only in a sound-present period, but in a sound-absent period, blank data generated by the blank generator 16, which correspond to encoded data in a sound-absent state, are outputted. Consequently, encoded data in both of a sound-present period and a sound-absent period are outputted substantially at a fixed bit rate.

A signal outputting element 17 is connected to a single output terminal of the signal selector 15, and a communication network 18 is connected to the signal outputting element 17.

The signal reception unit 3 includes a signal inputting element 21 serving as data reception means connected to the communication network 18. The signal inputting element 21 receives encoded data of a variable bit rate from the communication network 18.

A data converter 22 serving as rate conversion means is connected to the signal inputting element 21. The data converter 22 includes a reception discriminator 23 serving as reception discrimination means, a data generator 24 serving as data generation means, a data selector 25 serving as data selection means, and so forth.

The signal inputting element 21 is connected to the reception discriminator 23. The reception discriminator 23 discriminates after each fixed period whether or not encoded data are received, and selectively outputs a reception flag or a non-reception flag as reception state data corresponding to a result of the discrimination.

The data generator 24 is formed, for example, from a memory such as a RAM or from a constant voltage source such as a grounding terminal, and generates a pattern wherein "0" appears successively as a string of encoded data corresponding to a sound-absent state according to the ITU-T Recommendations G.728 system.

The data generator 24 and the signal inputting element 21 are connected to a pair of input terminals of the data selector 25, and the reception discriminator 23 is connected to a control terminal of the data selector 25.

The data selector 25 selects encoded data inputted to the signal inputting element 21 or encoded data generated by the data generator 24 in response to a reception flag or a non-reception flag outputted from the reception discriminator 23.

In short, in a sound-present period, encoded data inputted at a variable bit rate to the signal inputting element 21 are outputted from the data selector 25, but in a sound-absent period, encoded data of a sound-absent state generated from the data generator 24 are outputted. Consequently, encoded data in both of a sound-present period and a sound-absent period are outputted at a fixed bit rate.

A decoder 26 serving as decoding means is connected to a single output terminal of the data selector 25, and a sound outputting element 27 is connected to the decoder 26. The decoder 26 decodes encoded data in accordance with the ITU-T Recommendations G.728 system irrespective of whether sound is present or absent, and outputs a resulting digital audio signal at a fixed bit rate.

It is to be noted that the sound detector 12, the encoder 13, the reception discriminator 23, the decoder 26 and so forth are realized with an existing technique, for example, such as a microcomputer in which a suitable program is installed, or hardware formed from suitable wired logic.

A signal communication method by the signal communication apparatus 1 of the present embodiment having the construction described above is described below.

First, since the signal communication apparatus 1 of the present embodiment communicates a signal in accordance with the silence compression type, it can communicate a signal with another signal communication apparatus (not shown) of the silence compression type which is formed in a similar manner.

For example, if the signal communication apparatus 1 of the present embodiment tries to encode and transmit an audio signal, then when the audio signal is inputted to the audio inputting element 11, the sound detector 12 discriminates whether or not the audio signal is in a sound-present period or a sound-absent period, and selectively outputs a sound-present flag or a sound-absent flag. The encoder 13 encodes the audio signal in accordance with the ITU-T Recommendations G.728 irrespective of whether sound is present or absent.

Since the sound-present/absent flag and the encoded data are inputted in a synchronized relationship with each other to the signal selector 15, the signal selector 15 selects, when a sound-present flag is inputted, the encoded data inputted from the encoder 13, but selects, when a sound-absent flag is inputted, blank data generated by the blank generator 16.

Since the data selected in this manner are transmitted from the signal outputting element 17 to the communication network 18, the encoded data outputted from the encoder 13 are outputted at a variable bit rate only in a sound-present period.

It is to be noted that, since, in a sound-absent period, blank data generated by the blank generator 16 and corresponding to encoded data in a sound-absent state are outputted, the total encoded data in both of a sound-present period and a sound-absent period are outputted substantially at a fixed bit rate.

However, since the blank data in a sound-absent period include a succession of "0"s and because it is possible to multiplex other transmission data in the blank data, the signal transmission unit 2 of the signal communication apparatus 1 of the present embodiment functions as an encoding transmission apparatus of the silence compression type.

Further, if the signal communication apparatus 1 of the present embodiment tries to receive and decode encoded data from another signal communication apparatus of the silence compression type formed in a manner similar to the signal communication apparatus 1, when the encoded data are inputted to the signal inputting element 21, the reception discriminator 23 discriminates whether or not encoded data are received after each fixed interval of time, and selectively outputs a reception flag or a non-reception flag as reception state data corresponding to a result of the discrimination.

Since the reception/non-reception flag and the encoded data are inputted in a synchronized relationship with each other to the data selector 25, the data selector 25 selects, when a reception flag is inputted, the encoded data inputted to the signal inputting element 21, but selects, when a non-reception flag is inputted, encoded data generated by the data generator 24.

Since the encoded data selected in this manner are outputted at a fixed bit rate from the data selector 25 to the decoder 26, the decoder 26 decodes the encoded data inputted thereto in accordance with the ITU-T Recommendations G.728 system irrespective of whether sound is present or absent.

Since the digital audio signal decoded in this manner is outputted at a fixed bit rate from the sound outputting element 27, in a sound-present period, the inputted encoded data are decoded into and outputted as an audio signal, but in a sound-absent period, a silence state prepared in advance is regenerated.

Since the signal reception unit 3 of the signal communication apparatus 1 of the present embodiment decodes encoded data inputted at a variable bit rate into an audio signal and outputs the audio signal but decodes, in a sound-absent period, encoded data prepared in advance to regenerate a silence state as described above, the signal reception unit 3 can function as a reception decoding apparatus of the silence compression type.

It is to be noted that, where other transmission data are multiplexed with blank data which correspond to encoded data in a sound-absent state as described hereinabove, the multiplexed transmission data should be separated from the blank data portion before they are inputted to the signal reception unit 3, and the blank data should be replaced with a succession of "0"s.

While the signal communication apparatus 1 of the present embodiment can perform signal transmission and signal reception to and from another signal communication apparatus of the silence compression type as described above, it can also perform signal transmission and signal reception to and from a signal communication apparatus of the non-silence compression type.

In short, in the signal communication apparatus 1 of the present embodiment, when encoded data of an audio signal are to be transmitted at a variable bit rate only in a sound-present period, the signal transmission unit 2 transmits, in a sound-absent period, blank data corresponding to encoded data in a sound-absent state.

Consequently, this substantially corresponds to total transmission that includes both of encoded data in a sound-present period and in a sound-absent period at a fixed bit rate, and the encoded data can be received and decoded by a signal communication apparatus of the non-silence compression type.

Further, in the signal communication apparatus 1 of the present embodiment, the encoded data for regeneration of a sound-absent state are prepared in advance, and the signal reception unit 3 discriminates a soundpresent period and a sound-absent period of encoded data externally inputted thereto from a reception state.

Accordingly, in the signal communication apparatus 1 of the present embodiment, in order for the signal reception unit 3 to discriminate a sound-absent period and to regenerate a sound-absent state, the signal transmission unit 2 need not execute peculiar data processing.

Therefore, even if the signal reception unit 3 receives encoded data from a signal communication apparatus of the non-silence compression type, it can decode the encoded data in a manner similar to that for encoded data received from the signal transmission unit 2.

Particularly, since the signal communication apparatus 1 of the present embodiment executes encoding of an audio signal and decoding of encoded data in accordance with the ITU-T Recommendations G.728 system and prepares a succession of "0"s as encoded data for a sound-absent period, if a signal communication apparatus of the non-silence compression type also executes encoding and decoding in accordance with the ITU-T Recommendations G.728 system, then signal communication can be performed in a situation in which a sound-absent state is regenerated with accuracy.

In short, according to the encoding system of the LD-CELP of the ITU-T Recommendations G.728, encoding of 10 bits is performed in units of 5 samples of an audio signal of 64 kbps/s, which is a communication band of the telephone. The encoded data of 10 bits is formed from a gain codebook of 3 bits and a shape codebook of 7 bits. The codebook index which indicates a minimum gain of 3 bits as defined by the ITU-T Recommendations G.728 is "000".

Accordingly, encoded data formed from a gain codebook of 3 bits of "000" and an arbitrary shape codebook of 7 bits should be used as a sound-absent period switching pattern. Here, an example of the sound-absent period switching pattern is data "0000000000," wherein the 7 bits of the shape codebook are "0000000" is used.

According to the encoding system of the ITU-T Recommendations G.728, gain prediction is performed. In short, if a maximum value is successively inputted as a gain codebook, then the predicted gain increases and diverges, thereby entering an unstable operation state. If the minimum value sound-absent period switching pattern "0000000000" is successively inputted as a gain codebook, then the predicted gain decreases gradually and converges, thereby entering an operation state in which silence is decoded.

Then, since the signal communication apparatus 1 of the present embodiment uses, as encoded data which indicates a sound-absent state, encoded data wherein the minimum gain value "0" successively appears, it can directly communicate a signal also with a signal communication apparatus of the non-silence compression type.

Figure 3:
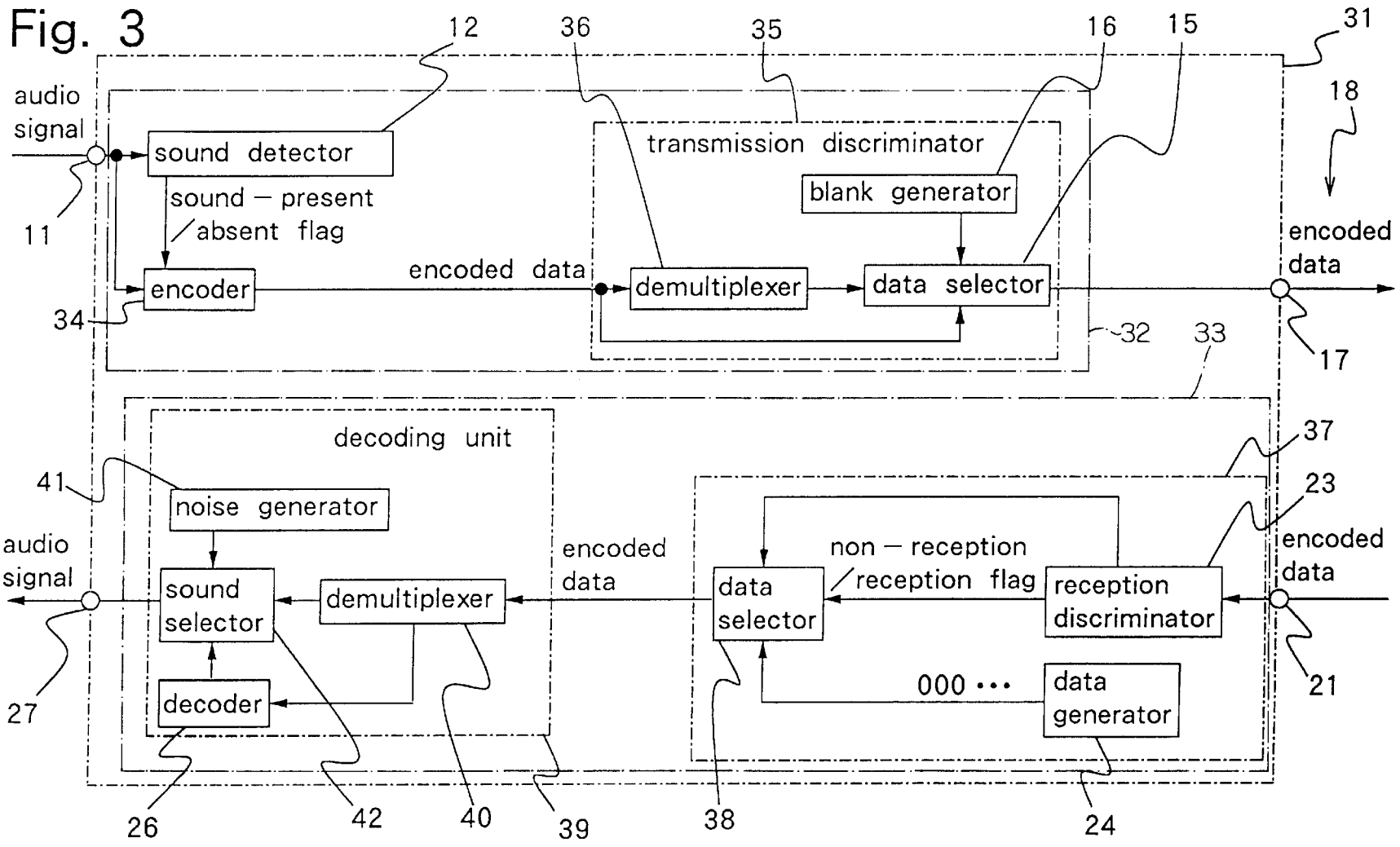
FIG. 3 is a view showing a construction of a second embodiment of a signal communication apparatus of the present invention.

In the following, a second embodiment of the present invention is described with reference to FIG. 3.

It is to be noted that, in the signal communication apparatus of the present embodiment, elements which are the same as those of the first embodiment described above are denoted by same names and reference numerals and detailed description thereof is omitted.

First, also the signal communication apparatus 31 of the present embodiment includes a signal transmission unit 32 which corresponds to an encoding transmission apparatus and a signal reception unit 33 which corresponds to a reception decoding apparatus.

In the signal transmission unit 32 in the present embodiment, a sound detector 12 serving as identification output means and an encoder 34 serving as encoding means are connected in parallel to each other and to an audio inputting element 11, and the sound detector 12 is connected to the encoder Since the encoder 34 not only encodes an audio signal in accordance with the ITU-T Recommendations G.728 system whether sound is present or absent but also multiplexes a sound-present/absent flag inputted from the sound detector 12 with the encoded data, it functions also as data multiplexing means.

The encoder 34 is connected to a transmission discriminator 35 serving as transmission discrimination means. The transmission discriminator 35 includes a demultiplexer 36 serving as data demultiplexing means, a signal selector 15 serving as signal selection means and a blank generator 16 serving as blank generation means.

The encoder 34 is connected to the demultiplexer 36 and one of a pair of input terminals of the signal selector 15, and the demultiplexer 36 is connected to a control terminal of the signal selector 15.

Since the demultiplexer 36 separates a sound-present/absent flag from encoded data, the signal selector 15 selects either encoded data outputted from the encoder 34 or blank data generated by the blank generator 16 in response to the sound-present/absent flag inputted thereto from the demultiplexer 36.

In the signal reception unit 33, a data converter 37 serving as rate conversion means is connected to a signal inputting element 21 serving as data reception means. The data converter 37 includes a reception discriminator 23 serving as reception discrimination means, a data generator 24 serving as data generation means, a d at a selector 38 serving as data selection means, and so forth.

The data selector 38 not only selects, in response to a reception flag or a non-reception flag outputted from the reception discriminator 23, encoded data inputted to the signal inputting element 21 or encoded data generated by the data generator 24 but also multiplexes a non-reception/ reception flag with the encoded data selected in this manner. Consequently, the data selector 38 functions also as data multiplexing means.

A decoding unit 39 serving as decoding means is connected to the data converter 37. The decoding unit 39 includes a demultiplexer 40 serving as data demultiplexing means, a decoder 26, a noise generator 41 serving as noise generation means, and a sound selector 42 serving as sound selection means.

The data converter 37 is connected to the demultiplexer 40 and the decoder 26, and the decoder 26 and the noise generator 41 are connected to a pair of input terminals of the sound selector 42. The sound selector 42 is connected at a control terminal thereof to the demultiplexer 40 and at an output terminal thereof to the sound outputting element 27.

The noise generator 41 is formed from a memory such as a RAM and stores an audio signal of artificial noise corresponding to background noise. The demultiplexer 40 separates a non-reception/reception flag from encoded data, and the sound selector 42 selects the audio signal of artificial noise generated by the noise generator 41 or an audio signal outputted from the decoder 26 in response to an input of the non-reception/reception flag.

A signal communication method that uses the signal communication apparatus 31 of the present embodiment, having such a construction as described above, is described simply below.

Also the signal communication apparatus 31 of the present embodiment communicates a signal with another signal communication apparatus (not shown) of the silence compression type or of the non-silence compression type, in a manner similar to the signal communication apparatus 1 described hereinabove.

When the signal communication apparatus 31 of the present embodiment tries to encode and transmit an audio signal, the signal transmission unit 32 multiplexes a sound-present/absent flag with the encoded data. Similarly, when the signal communication apparatus 31 of the present embodiment tries to receive and decode encoded data from another signal communication apparatus, also the signal reception unit 33 multiplexes a non-reception/reception flag with the encoded data.

In this manner, in the signal communication apparatus 31 of the present embodiment, since the internal operating conditions of the signal transmission unit 32 and the signal reception unit 33 coincide with each other, deterioration in quality of an audio signal that is encoded and then decoded is prevented.

In short, in the LD-CELP of the ITU-T Recommendations G.728 and so forth, encoding and decoding are performed with previous information of an input audio signal using a backward linear prediction technique or a like technique. In particular, presupposing that audio decoding processing is performed using an internal operation condition the same as that of the signal transmission unit 32 based on successive encoded data transmitted from the signal reception unit 33, the signal transmission unit 32 performs encoding by predicting a decoded signal based on a previous result of analysis of an input audio signal.

In the silence compression type wherein encoded data are transmitted only in a sound-present period using the signal transmission unit 32 having such a construction as described above, in a sound-absent period in which encoded data are not transmitted, the internal operation conditions of the signal transmission unit 32 and of the signal reception unit 33, particularly predictive coefficients in a linear prediction method, become out of coincidence with each other, and the quality of sound at a beginning portion of a sound-present period, that is, at the start of speech, is deteriorated.

In order to cope with such deterioration of the sound quality, in the signal communication apparatus 31 of the present embodiment, stopping control of a data processing operation is performed by the signal transmission unit 32 and the signal reception unit 33 in a sound-absent period.

In particular, in a sound-present period, the signal transmission unit 32 multiplexes a sound-present flag and encodes and outputs an audio signal. In a sound-absent period of a sound-absent flag, the signal transmission unit 32 stops the data processing, and multiplexes a sound-absent flag with blank data and outputs the multiplexed data.

The signal reception unit 33 decodes encoded data in a sound-present period of a reception flag, but stops, in a sound-absent period of a non-reception flag, the data processing operation in a manner similar to the stoppage by; the signal transmission unit 32, thereby preventing the operation state of the signal reception unit 33 from becoming out of coincidence with the operation state of the signal transmission unit 32.

Particularly, in the signal communication apparatus 31 of the present embodiment, when the signal reception unit 33 decodes encoded data into an audio signal, if a non-reception flag is multiplexed with the encoded data, then the audio signal decoded from the encoded data is not outputted, but artificial noise prepared in advance is outputted. Consequently, the signal communication apparatus 31 of the present embodiment can output an audio signal in a sound-absent period in a natural state.

It is to be noted that, while, in the present embodiment, it is described as an example above that artificial noise prepared in advance is outputted in a sound-absent period, it is otherwise possible to decode and output encoded data of a sound-absent state generated by the data generator 24.

Figure 4:
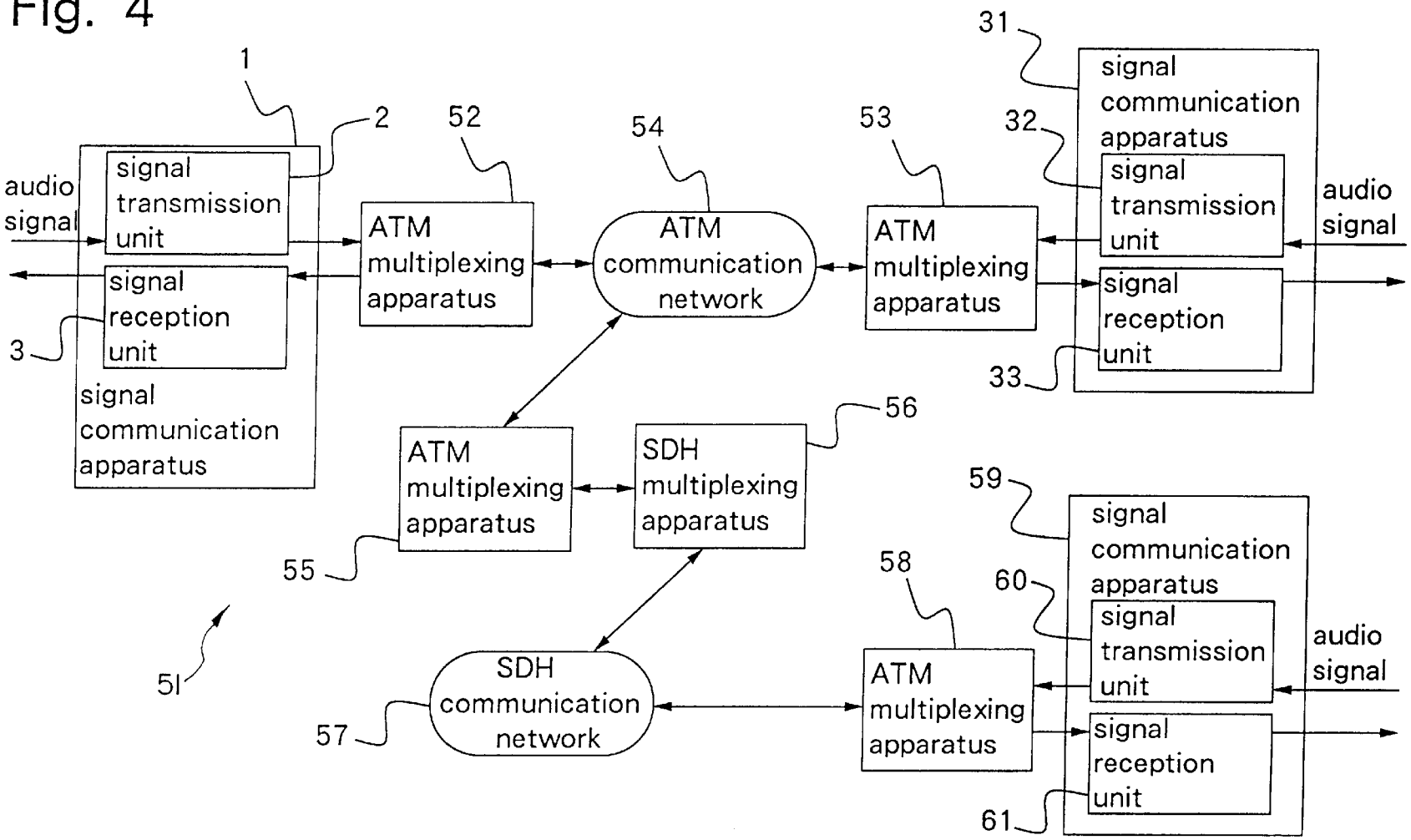
FIG. 4 is a view showing a construction of a third embodiment of a signal communication system of the present invention.

Further, a third embodiment of the present invention is described with reference to FIG. 4.

It is to be noted that, in the signal communication system of the present embodiment, elements which are the same as those of the first and second embodiments described above are denoted by same names and reference numerals, and detailed description thereof is omitted.

In the signal communication system 51 of the present embodiment, the signal communication apparatus 1 and 31 described above are connected to an ATM communication network 54 via ATM multiplexing apparatus 52 and 53, respectively. An SDH communication network 57 is connected to the ATM communication network 54 via an ATM multiplexing apparatus 55 and an SDH multiplexing apparatus 56, and a signal transmission unit 60 and a signal reception unit 61 of a signal communication apparatus 59 of the silence compression type are connected to the SDH communication network 57 via an SDH multiplexing apparatus 58.

In the signal communication system 51 having the construction described above, each of the signal communication apparatus 1 and 31 can transmit, although it is of the silence compression type as described above, encoded data in a condition such that the encoded data can be decoded by the signal communication apparatus 59 of the non-silence compression type, and can decode encoded data of the non-silence compression type.

Consequently, in the signal communication system of the present embodiment, the signal communication apparatus 1 or 31, of the silence compression type, of the ATM communication network 54 and the signal communication apparatus 59, of the non-silence compression type, of the SDH communication network 57 can communicate with each other only by way of the ATM multiplexing apparatus 55 and the SDH multiplexing apparatus 56.

While the invention has been described in terms of preferred embodiments with several modifications, those skilled in the art will recognize that the invention can be practiced with other modifications within the spirit and scope of the appended claims.

What is claimed is:

1. An encoding transmission method of the silence compression type for encoding an audio signal, transmitting the encoded audio signal in a sound-present period, and withholding the transmission of the encoded audio signal in a sound-absent period, comprising:

discriminating whether the audio signal is in a sound-present period or a sound-absent period and then outputting the result of this discrimination as period identification data;

encoding the audio signal and then outputting the encoded audio signal data at a fixed bit rate;

generating blank data;

transmitting the blank data at said fixed bit rate when the period identification data represents a sound-absent period;

withholding transmission of the encoded audio signal data when the period identification data represents a sound-absent period; and transmitting the encoded audio signal data when the period identification data represents a sound-present period;

wherein the transmission effects silence compression transmission that can be directly received by either a silence compression or non-silence compression type receiver.

2. An encoding transmission method of the silence compression type for encoding an audio signal, transmitting the encoded audio signal in a sound-present period, and withholding the transmission of the encoded audio signal in a sound-absent period, comprising:

discriminating whether the audio signal is in a sound-present period or a sound-absent period and then outputting the result of this discrimination as period identification data;

encoding the audio signal and outputting the encoded audio signal data at a fixed bit rate;

multiplexing the period identification data with the encoded audio signal data;

separating, from the multiplexed data, the period identification data from the encoded audio signal data;

selecting and transmitting blank data prepared in advance when the separated period identification data represents a sound-absent period; and selecting and transmitting the encoded audio signal data when the separated period identification data represents a sound-present period;

wherein the selection maintains the fixed bit rate.

3. An encoding transmission apparatus of the silence compression type, wherein an audio signal is encoded and is then transmitted in a sound-present period and is not then transmitted in a sound-absent period, comprising:

identification output means for discriminating whether the audio signal is in a sound-present period or a sound-absent period and outputting the result of this discrimination as period identification data;

encoding means for encoding the audio signal and outputting the encoded audio signal data at a fixed bit rate; and transmission discrimination means for withholding transmission of the encoded audio signal data outputted from said encoding means when the period identification data outputted from said identification output means represents a sound-absent period, and for transmitting the encoded audio signal data when the period identification data represents a sound-present period;

wherein the transmission discrimination means effects silence compression and a substantially fixed bit rate.

4. An encoding transmission apparatus as claimed in claim 3, further comprising:

data muiltiplexing means for multiplexing the period identification data with the encoded audio signal data, wherein said transmission discrimination means further comprises:

data demultiplexing means for separating the period identification data from the encoded audio signal data; and signal selection means for withholding transmission of the encoded audio signal data when the period identification data separated by said data demultiplexing means represents a sound-absent period, and for transmitting the encoded audio signal data when the period identification data separated by said data demultiplexing means represents a sound-present period.

5. An encoding transmission apparatus as claimed in claim 3, wherein said encoding means includes means for encoding the audio signal in accordance with the ITU-T Recommendations G.728 system.

6. An encoding transmission apparatus as claimed in claim 3, wherein the blank data comprise a string having a pattern wherein one of two binary values appears successively.

7. An encoding transmission apparatus as claimed in claim 3, wherein said encoding means includes means for encoding the audio signal in accordance with the ITU-T Recommendations G.728 system.

8. An encoding transmission apparatus as claimed in claim 3, wherein said transmission discrimination means comprises:

blank generation means for generating blank data at a second bit rate; and signal selection means for selecting the blank data generated by said blank generation means when the period identification data outputted from said identification output means represents a sound-absent period, and for selecting the encoded audio signal data outputted by said encoding means when the period identification data represents a sound-present period;

and wherein the selection maintains a substantially fixed bit rate.

9. An encoding transmission apparatus of the silence compression type, wherein an audio signal is encoded and is then transmitted in a sound-present period and is not then transmitted in a sound-absent period, comprising:

a discriminator that outputs period identification data in response to a discrimination of whether the audio signal is in a sound-present period or a sound-absent period;

an encoder that outputs encoded audio signal data at a fixed bit rate in response to the audio signal; and a transmission discriminator that withholds transmission of the encoded audio signal data outputted from said encoder when the period identification data outputted from said discriminator represents a sound-absent period, and that transmits the encoded audio signal data when the period identification data represents a sound-present period, wherein said transmission discriminator comprises:

a blank generator that generates blank data, the blank data for maintaining a substantially fixed bit rate when the period identification data outputted from said discriminator represents a sound-absent period.

10. An encoding transmission apparatus as claimed in claim 9, further comprising:

a data muiltiplexer that multiplexes the period identification data with the encoded audio signal data, wherein said transmission discriminator further comprises:

a data demultiplexer that separates the period identification data from the encoded audio signal data; and a signal selector that withholds transmission of the encoded audio signal data when the period identification data separated by said data demultiplexer represents a sound-absent period, and that transmits the encoded audio signal data when the period identification data separated by said data demultiplexer represents a sound-present period.

11. An encoding transmission apparatus as claimed in claim 9, further comprising:

a data multiplexer that multiplexes the period identification data with the encoded audio signal data, wherein said transmission discriminator includes:

a data demultiplexer that separates the period identification data from the encoded audio signal data; and a signal selector that selects the blank data generated by said blank generator when the period identification data separated by said data demultiplexer represents a sound-absent period, and that selects the encoded audio signal data outputted by said encoder when the period identification data represents a sound-present period.

12. An encoding transmission apparatus as claimed in claim 11, wherein said encoder encodes the audio signal in accordance with the ITU-T Recommendations G.728 system.

13. An encoding transmission apparatus as claimed in claim 11, wherein the blank data comprise a string having a pattern wherein one of two binary values appears successively.

14. An encoding transmission apparatus as claimed in claim 9, wherein said encoder encodes the audio signal in accordance with the ITU-T Recommendations G.728 system.

15. A reception decoding method of the silence compression type for receiving and decoding encoded data of a variable bit rate that are transmitted in a sound-present period of an audio signal and that are not transmitted in a sound-absent period of the audio signal, comprising:

receiving the encoded data of a variable bit rate;

discriminating whether or not the encoded data of a variable bit rate have been received during each of fixed intervals and then outputting the discrimination result for each said fixed interval as reception state data;

outputting the encoded data at a fixed bit rate when the reception state data indicates that encoded data of a variable bit rate have been received during a fixed interval;

outputting encoded data of a sound-absent state prepared in advance when the reception state data indicates that encoded data of a variable bit rate have not been received during a fixed interval; and decoding and outputting the encoded data outputted at the fixed bit rate.

16. A reception decoding method of the silence compression type for receiving and decoding encoded data of a variable bit rate that are transmitted in a sound-present period of an audio signal and that are not transmitted in a sound-absent period of the audio signal, comprising:

receiving the encoded data of a variable bit rate;

discriminating whether or not the encoded data have been received during each of fixed intervals and then outputting the discrimination result for said each fixed interval as reception state data;

outputting the encoded data after each fixed interval, when the reception state data represents that the encoded data have been received;

generating predetermined encoded data after each fixed interval, when the reception state data represents that the encoded data have not been received;

multiplexing the corresponding reception state data with the encoded data outputted at a fixed bit rate;

separating the reception state data from the encoded data multiplexed with the reception state data and outputted at the fixed bit rate;

decoding and outputting the encoded data when the separated reception state data represents that the encoded data are received after each fixed time; and outputting artificial noise when the reception state data represents that the encoded data are not received after each fixed time.

17. A reception decoding apparatus of the silence compression type for receiving and decoding encoded data of a variable bit rate that are transmitted in a sound-present period of an audio signal and that are not transmitted in a sound-absent period of the audio signal, comprising:

data reception means for receiving the encoded data of a variable bit rate;

rate conversion means for selecting, when said data reception means receives the encoded data of a variable bit rate during a fixed interval, the encoded data received by said data reception means, and for selecting, when said data reception means does not receive the encoded data of a variable bit rate during said fixed interval, encoded data of a sound-absent state prepared in advance, and for outputting the selected encoded data at a fixed bit rate; and decoding means for decoding and outputting the selected encoded data outputted at the fixed bit rate by said rate conversion means.

18. A reception decoding apparatus as claimed in claim 17, wherein said encoding means includes means for encoding the audio signal in accordance with the ITU-T Recommendations G.728 system.

19. A reception decoding apparatus of the silence compression type for receiving and decoding encoded data of a variable bit rate that are transmitted in a sound-present period of an audio signal and that are not transmitted in a sound-absent period of the audio signal, comprising:

data reception means for receiving the encoded data of a variable bit rate;

rate conversion means for selecting, when said data reception means receives the encoded data during a fixed interval, the encoded data received by said data reception means, and for selecting, when said data reception means does not receive the encoded data during said fixed interval, encoded data of a sound-absent state prepared in advance, and outputting the selected encoded data at a fixed bit rate; and decoding means for decoding and outputting the encoded data outputted at the fixed bit rate by said rate conversion means;

wherein said rate conversion means includes:

reception discrimination means for discriminating whether or not said data reception means has received the encoded data during said each fixed interval and then outputting the discrimination result for said each fixed interval as reception state data;

data generation means for generating encoded data of a sound-absent state prepared in advance; and data selection means for selecting the encoded data received by said data reception means when the reception state data represents that the encoded data have been received during each fixed interval, and for selecting the encoded data generated by said data generation means when the reception state data represents that the encoded data have not been received during each fixed interval, and for then outputting the selected encoded data at a fixed bit rate.

20. A reception decoding apparatus of the silence compression type for receiving and decoding encoded data of a variable bit rate that are transmitted in a sound-present period of an audio signal and that are not transmitted in a sound-absent period of the audio signal, comprising:

a data receiver that receives the encoded data of a variable bit rate;

a rate converter that selects, when said data receiver receives the encoded data during a fixed interval, the encoded data received by said data receiver, and that selects, when said data receiver does not receive the encoded data during said fixed interval, encoded data of a sound-absent state prepared in advance, and that then outputs the selected encoded data at a fixed bit rate; and a decoder that decodes and outputs the encoded data outputted at the fixed bit rate by said rate converter.

21. A reception decoding apparatus as claimed in claim 20, wherein said encoder encodes the audio signal in accordance with the ITU-T Recommendations G.728 system.

22. A reception decoding apparatus of the silence compression type for receiving and decoding encoded data of a variable bit rate that are transmitted in a sound-present period of an audio signal and that are not transmitted in a sound-absent period of the audio signal, comprising:

a data receiver that receives the encoded data of a variable bit rate;

a rate converter that selects, when said data receiver receives the encoded data during a fixed interval, the encoded data received by said data receiver, and that selects, when said data receiver does not receive the encoded data during said fixed interval, encoded data of a sound-absent state prepared in advance, and that then outputs the selected encoded data at a fixed bit rate; and a decoder that decodes and outputs the encoded data outputted at the fixed bit rate by said rate converter;

wherein said rate converter includes:

a reception discriminator that discriminates whether or not said data receiver has received the encoded data during said each fixed interval and then outputs the discrimination result for said each fixed interval as reception state data;

a data generator that generates encoded data of a sound-absent state; and a data selector that selects the encoded data received by said data receiver when the reception state data represents that the encoded data have been received during each fixed interval, and that selects the encoded data generated by said data generator when the reception state data represents that the encoded data have not been received during each fixed interval, and that then outputs the selected encoded data at a fixed bit rate.

23. A reception decoding apparatus of the silence compression type for receiving and decoding encoded data of a variable bit rate that are transmitted in a sound-present period of an audio signal and that are not transmitted in a sound-absent period of the audio signal, comprising:

data reception means for receiving the encoded data of a variable bit rate;

reception discrimination means for discriminating whether or not said data reception means has received the encoded data during each fixed interval and then outputting the discrimination result for each fixed interval as reception state data;

rate conversion means for selecting the encoded data received by said data reception means when the reception state data represents that the encoded data have been received during each fixed interval, and for selecting predetermined encoded data prepared in advance when the reception state data represents that the encoded data have not been received during each fixed interval, and for outputting the selected encoded data at a fixed bit rate;

data multiplexing means for multiplexing, with the encoded data outputted at the fixed bit rate from said rate conversion means, the corresponding reception state data;

data demultiplexing means for separating the reception state data from the encoded data multiplexed with the reception state data by said data multiplexing means and outputted at the fixed bit rate; and decoding means for decoding and outputting the encoded data when the reception state data separated by said data demultiplexing means represents that the encoded data have been received during each fixed interval, and for outputting artificial noise prepared in advance when the reception state data represents that the encoded data have not been received during each fixed interval.

24. A reception decoding apparatus as claimed in claim 23, wherein said rate conversion means includes:

data generation means for generating predetermined encoded data prepared in advance; and data selection means for selecting the encoded data received by said data reception means when the reception state data represents that the encoded data have been received during each fixed interval, and for selecting the encoded data generated by said data generation means when the reception state data represents that the encoded data have not been received during each fixed interval, and for outputting the selected encoded data at a fixed bit rate.

25. A reception decoding apparatus as claimed in claim 24, wherein said data generation means includes means for generating the encoded data of a sound-absent state prepared as a string pattern wherein one of two binary values appears successively.

26. A reception decoding apparatus as claimed in claim 23, wherein said decoding means includes:

noise generation means for generating artificial noise prepared in advance;

data decoding means for decoding and outputting the encoded data; and sound selection means for selecting the audio signal outputted from said decoding means when the reception state data separated by said data demultiplexing means represents that the encoded data have been received during each fixed interval, and for selecting the artificial noise generated by said noise generation means when the reception state data presents that the encoded data have not been received during each fixed interval.

27. A reception decoding apparatus as claimed in claim 23, wherein said encoding means includes means for encoding the audio signal in accordance with the ITU-T Recommendations G.728 system.

28. A reception decoding apparatus of the silence compression type for receiving and decoding encoded data of a variable bit rate that are transmitted in a sound-present period of an audio signal and that are not transmitted in a sound-absent period of the audio signal, comprising:

a data receiver that receives the encoded data of a variable bit rate;

a reception discriminator that discriminates whether or not said data receiver has received the encoded data during each fixed interval and then outputs the discrimination result for each fixed interval as reception state data;

a rate converter that selects the encoded data received by said data receiver when the reception state data represents that the encoded data have been received during each fixed interval, and that selects predetermined encoded data when the reception state data represents that the encoded data have not been received during each fixed interval, and that then outputs the selected encoded data at a fixed bit rate;

a data multiplexer that multiplexes, with the encoded data outputted at the fixed bit rate from said rate converter, the corresponding reception state data;

a data demultiplexer that separates the reception state data from the encoded data multiplexed with the reception state data by said data multiplexer and outputted at the fixed bit rate; and a decoder that decodes and outputs the encoded data when the reception state data separated by said data demultiplexer represents that the encoded data have been received during each fixed interval, and that outputs artificial noise when the reception state data represents that the encoded data have not been received during each fixed interval.

29. A reception decoding apparatus as claimed in claim 28, wherein said rate converter includes:

a data generator for generating predetermined encoded data; and a data selector for selecting the encoded data received by said data receiver when the reception state data represents that the encoded data have been received during each fixed interval, and for selecting the encoded data generated by said data generator when the reception state data represents that the encoded data have not been received during each fixed interval, and for outputting the selected encoded data at a fixed bit rate.

30. A reception decoding apparatus as claimed in claim 29, wherein said data generator generates the predetermined encoded data of a sound-absent state, and wherein said predetermined encoded data are 1 a string pattern wherein one of two binary values appears successively.

31. A reception decoding apparatus as claimed in claim 28, wherein said decoder includes:

a noise generator for generating artificial noise;

a data decoder for decoding and outputting the encoded data; and a sound selector for selecting the audio signal outputted from said decoder when the reception state data separated by said data demultiplexer represents that the encoded data have been received during each fixed interval, and for selecting the artificial noise generated by said noise generator when the reception state data presents that the encoded data have not been received during each fixed interval.

32. A reception decoding apparatus as claimed in claim 28, wherein said encoder encodes the audio signal in accordance with the ITU-T Recommendations G.728 system.

* * * * *